US005423190A

United States Patent [19]

Friedland

[11] Patent Number: 5,423,190

[45] Date of Patent: Jun. 13, 1995

[54] APPARATUS FOR EVACUATING AND CHARGING A REFRIGERATION UNIT

[75] Inventor: Anthony E. Friedland, Apple Valley, Minn.

[73] Assignee: Thermo King Corporation, Minneapolis, Minn.

[21] Appl. No.: 289,580

[22] Filed: Aug. 15, 1994

Related U.S. Application Data

[62] Division of Ser. No. 219,585, Mar. 28, 1994, Pat. No. 5,377,493.

[51] Int. Cl.[6] ..... F25B 45/00

[52] U.S. Cl. ..... 62/149; 62/292

[58] Field of Search ..... 62/77, 149, 292

[56] References Cited

U.S. PATENT DOCUMENTS 3,873,289 3/1975 White ..... 62/149

4,441,330 4/1984 Lower et al. ..... 62/149

*Primary Examiner*—John M. Sollecito

*Attorney, Agent, or Firm*—M. G. Panian

[57] ABSTRACT

Apparatus for evacuating and charging a refrigeration unit having a compressor; a condenser; a receiver; an evaporator; hot gas, liquid and suction lines; and suction, discharge and liquid line service valves each having a service port position. A vacuum pump is provided which has first, second and third vacuum hoses respectively connected to the suction, discharge and liquid line service valves, with each vacuum hose having a controllable valve. Refrigerant supply apparatus is provided which is connected to the liquid line service valve. A method includes the steps of actuating the suction, discharge and liquid line service valves to open their service port positions, opening the controllable valves associated with the first, second and third vacuum hoses, operating the vacuum pump to provide a predetermined vacuum in the refrigeration unit via the first, second and third vacuum hoses, closing the controllable valves associated with the first, second and third vacuum hoses, charging the refrigeration unit via the liquid line service valve with refrigerant from the refrigerant supply apparatus, actuating the suction, discharge and liquid line service valves to close their service port positions, and removing the first, second and third vacuum hoses and refrigerant supply means from the suction, discharge and liquid line service valves. The apparatus includes means connecting the refrigerant supply apparatus to the third vacuum hose.

8 Claims, 7 Drawing Sheets

APPARATUS FOR EVACUATING AND CHARGING A REFRIGERATION UNIT

This is a division of application Ser. No. 08/219,585 filed Mar. 28, 1994, now U.S. Pat. No. 5,377,493.

TECHNICAL FIELD

The invention relates in general to mechanical refrigeration, and more specifically to methods and apparatus for evacuating and charging a mechanical refrigeration unit with refrigerant.

BACKGROUND ART

Mechanical refrigeration units are evacuated and filled with a refrigerant. The efficiency and reliability of this evacuation and charging process usually depends, at least to some degree, upon the skill of a person performing the process. It would be desirable, and it is an object of the invention, to provide methods and apparatus which result in the evacuation and charging of a refrigeration unit with very little interaction between the evacuation and charging apparatus and a human attendant, and with the interaction which is required being confined to actions which are not critical to the efficiency and reliability of the process.

The evacuation and charging of each refrigeration unit follows the same processing steps, but each refrigeration unit responds differently to the processing steps, such as in the amount of time required to reach predetermined vacuum thresholds, the vacuum levels at different points of measurement, and the vacuum values after vacuum hold cycles. Long term reliability and quality of evacuated and charged refrigeration units could be improved by recording critical evacuation and charging process data while evacuating and charging each refrigeration unit, and by tying this recorded data to the serial number of the associated refrigeration unit. This would permit process evaluation and meaningful process changes and fine tuning of the manufacturing process. Thus, it would be desirable, and it is another object of the invention to provide new and improved refrigeration evacuation and charging methods and apparatus which result in the building of a data bank which includes certain critical information concerning the evacuation and charging of each refrigeration unit, with the data being tied to the serial number of unit it applies to.

SUMMARY OF THE INVENTION

Briefly, the invention includes a method of evacuating and charging a refrigeration unit having a compressor; a condenser; a receiver; an evaporator; hot gas, liquid and suction lines; and suction, discharge and liquid line service valves each having a service port position. The method includes the steps of providing a vacuum pump having first, second and third vacuum hoses with controllable valves, and connecting the first, second and third vacuum hoses to the suction, discharge and liquid line service valves, respectively. The method further includes providing refrigerant supply means, and connecting the refrigerant supply means to the liquid line service valve. The method then includes the steps of actuating the suction, discharge and liquid line service valves to open their service port positions, opening the controllable valves associated with the first, second and third vacuum hoses, operating the vacuum pump to provide a predetermined vacuum in the refrigeration unit via the first, second and third vacuum hoses, closing the controllable valves associated with the first, second and third vacuum hoses, charging the refrigeration unit via the liquid line service valve with refrigerant from the refrigerant supply means, actuating the suction, discharge and liquid line service valves to close their service port positions, and removing the first, second and third vacuum hoses and refrigerant supply means from the suction, discharge and liquid line service valves.

In a preferred embodiment of the invention the step of connecting the refrigerant supply means to the liquid line service valve includes the step of connecting the refrigerant supply means to the third vacuum hose. Thus, the step of connecting the third vacuum hose to the liquid line service valve also performs the step of connecting the refrigerant supply means to the liquid line service valve.

The invention includes apparatus for evacuating and charging a refrigeration unit having a compressor; a condenser; a receiver; an evaporator; hot gas, liquid and suction lines; and suction, discharge and liquid line service valves. The apparatus includes a vacuum pump having first, second and third vacuum hoses with controllable valves. The first, second and third vacuum hoses are adapted for connection to the discharge, suction and liquid line service valves, respectively. The apparatus further includes controllable refrigerant supply means, means connecting the controllable refrigerant supply means to the third vacuum hose, and control means. The control means controls the vacuum pump, the controllable valves of the first, second and third vacuum hoses, and the controllable refrigerant supply means, after the first, second and third vacuum hoses have been respectively connected to the suction, discharge and liquid line service valves of a refrigeration unit, to automatically evacuate and charge the refrigeration unit with refrigerant, without the necessity of removing vacuum hoses after the refrigeration unit has been evacuated.

In a preferred embodiment of the apparatus, refrigeration units to be evacuated and charged by the apparatus each include a bar code which identifies the production serial number of the associated unit. The control means includes means for reading the bar code to determine the serial number, means for determining from the serial number the type and amount of refrigerant required for a refrigeration unit to be evacuated and charged, and means for metering the determined amount of the correct refrigerant into a connected refrigeration unit.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
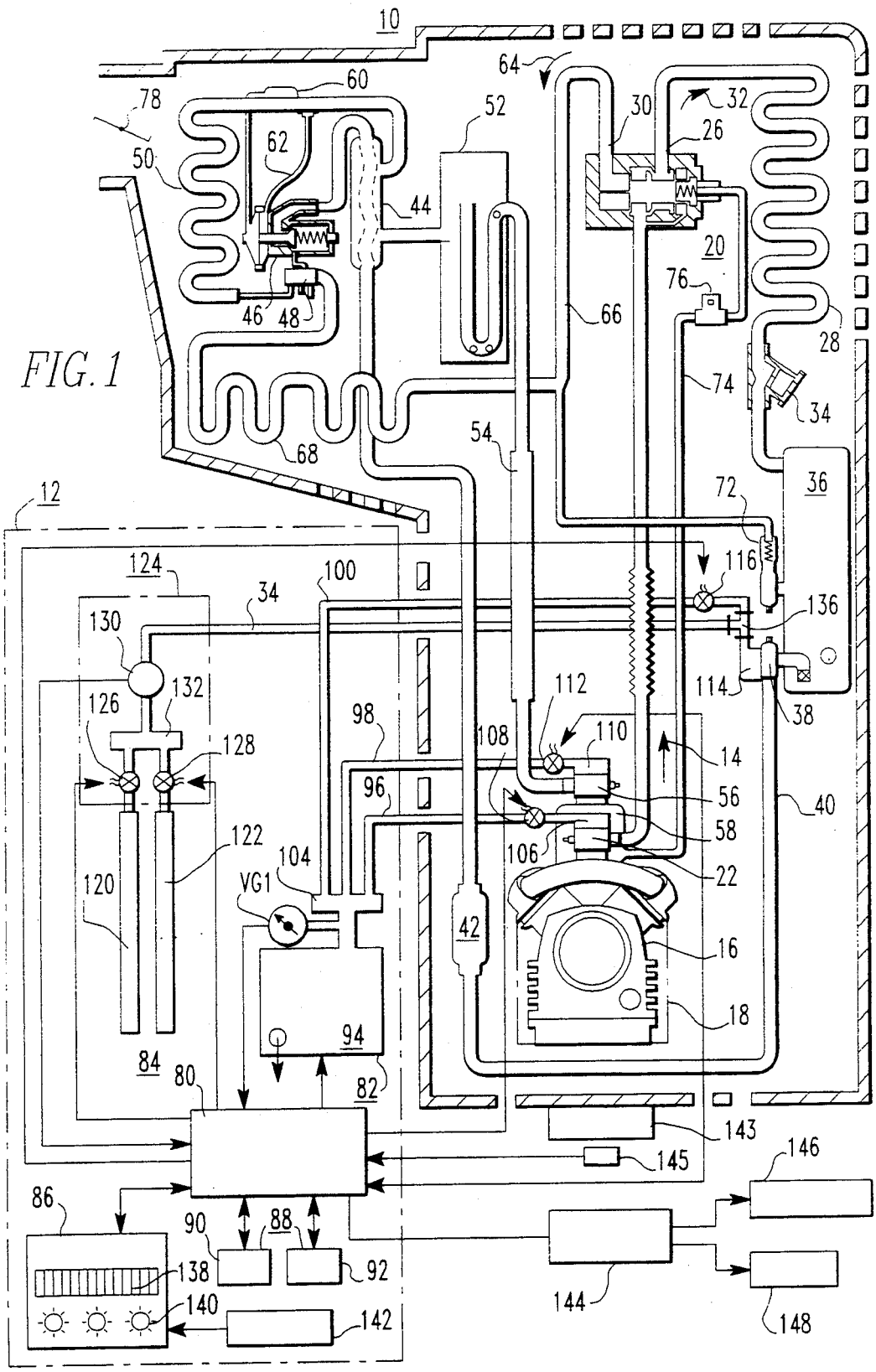
FIG. 1 is partially schematic and partially diagrammatic view of a refrigeration unit, and apparatus for evacuating and charging the refrigeration unit according to the teachings of the invention.

Referring now to the drawing, and to FIG. 1 in particular, there is shown a refrigeration unit 10, such as a transport refrigeration, which may be evacuated and charged with a refrigerant from an evacuation and refrigerant charging apparatus 12 constructed according to the teachings of the invention. Refrigeration unit 10 has a closed fluid refrigerant flow path 14 which includes a refrigerant compressor 16 driven by a prime mover 18, with the prime mover 18 being shown in broken outline.

Discharge ports of compressor 16 are connected to an inlet port of a three-way valve 20 via a discharge service valve 22 and a hot gas line 24. The functions of three-way valve 20, which selects heating and cooling cycles, may be provided by two separate valves, if desired. Three-way valve 20 has a first outlet port 26, which is selected to initiate a cooling cycle, with the first output port 26 being connected to the inlet side of a condenser coil 28. Three-way valve 20 has a second outlet port 30, which is selected to initiate a heating cycle.

When three-way valve 20 selects the first or cooling cycle outlet port 26, it connects compressor 16 in a first refrigerant flow path 32, which in addition to condenser coil 28, includes a one-way condenser check valve 34, a refrigerant receiver 36, a liquid line service valve 38, a liquid line 40, a refrigerant dryer 42, a first pass through a heat exchanger 44, an expansion valve 46, a refrigerant distributor 48, an evaporator coil 50, another pass through heat exchanger 44, an accumulator 52, a suction line 54, and back to a suction port of compressor 16 via a suction line service valve 56 and a throttling valve 58. Expansion valve 46 is controlled by a thermal bulb 60 and a pressure equalizer line 62.

When three-way valve 20 selects the second or heating cycle outlet port 30, it connects compressor 26 in a second refrigerant flow path 64. The second refrigerant flow path 64 by-passes condenser coil 28 and expansion valve 46, connecting the hot gas output of compressor 16 to the refrigerant distributor 48 via a hot gas line 66 and a defrost pan heater 68. A by-pass or pressurizing line 70 connects hot gas line 66 to receiver 36 via by-pass valve and check valve apparatus 72, to force refrigerant from receiver 36 ,into an active refrigerant circuit during heating and defrost cycles.

A conduit or line 74 connects three-way valve 20 to the low pressure side of compressor 16 via a normally closed pilot solenoid valve 76. When pilot solenoid valve 76 is de-energized and thus closed, three-way valve 20 is spring biased to select the first or cooling cycle outlet port 26. When evaporator coil 50 requires defrosting, and when a load being conditioned in an associated conditioned space requires heat to maintain set point, pilot solenoid valve 76 is energized to allow the low pressure side of compressor 26 to operate three-way valve 20 to select the second or heating cycle outlet port 30.

During operation of refrigeration unit 10, a condenser fan or blower (not shown) causes ambient air to flow through condenser coil 28, with the resulting heated air being discharged to the atmosphere. An evaporator fan or blower (not shown) draws air from a served space whose air is to be conditioned, through the evaporator coil 50, and the resulting conditioned air is returned to the conditioned space. During a heat cycle initiated to defrost evaporator coil 50, a discharge air damper 78 is operated to close the discharge air path to the associated conditioned space.

Each of the discharge, liquid line and suction service valves 22, 38 and 56 are actuatable between a back-seated position, a front-seated position, and a service valve position. The back-seated position is the normal position of each service valve, with a service port on each valve being blocked while refrigerant is allowed to flow through the valve. The front-seated position blocks refrigerant flow through the valve, and is used, for example, to check or remove compressor 16. The service valve position is intermediate the back-seated and front-seated positions, with the service valve position opening the service port as well as allowing refrigerant to flow through the service valve.

The evacuation and refrigerant charging apparatus 12 includes a microprocessor based controller 80, such as a programmable logic controller (PLC), vacuum pump means 82, refrigerant supply means 84, display means 86, and memory means 88. Memory means 88 includes a read-only memory (ROM) 90 and a random-access memory (RAM) 92.

The vacuum pump means 82 includes a vacuum pump 94, first, second and third vacuum hoses 96, 98 and 100, and a vacuum gage VG1, such as an electronic vacuum gauge. Vacuum hose 96 has an end connected to a vacuum hose manifold 104 on vacuum pump 94, and an end which has a clamp or connector 106 adapted for connection to the service port of discharge service valve 22. FIG. 1 illustrates connector 106 connected to the service port of discharge service valve 22, and thus the service port itself is not visible. Vacuum hose 96 also has a controllable on-off valve 108, such as a solenoid valve, with valve 108 being is controlled by controller 80.

In like manner, vacuum hose 98 has an end connected to vacuum hose manifold 104, an end having a clamp or connector 110 adapted for connection to the service port of suction service valve 56, and a controllable valve 112. Vacuum hose 100 has an end connected to vacuum hose manifold 104, an end having a clamp or connector 114 adapted for connection to the service port of liquid line service valve 38, and a controllable valve 116.

Refrigerant supply means 84 may include only one type of refrigerant, such as for manufacturing lines where only one type of refrigerant is required. In the manufacture of transport refrigeration units the evacuation and refrigerant charging apparatus 12 may be used with both truck and trailer types of refrigeration units, with the truck and trailer refrigeration units sometimes requiring different types of refrigerant. Also a different refrigerant may be used in a unit which will be used primarily for deep frozen applications, than in a unit which will be used primarily for conditioning fresh loads. Examples of different refrigerants which may be used include R-12, R-22, R-134a, and R-502, for example.

The construction of the refrigerant supply means 84 is not part of the present invention, and may be obtained commercially from many sources. For purposes of example, refrigerant supply means 84 is illustrated as having first and second selectable refrigerant sources 120 and 122, which may be bulk refrigerant storage tanks, or large, eg., one ton, portable cylinders, each having a refrigerant flow pump and a temperature controlled refrigerant supply accumulator. The number of refrigerant sources and the types of refrigerant contained in each will depend upon the specific application of evacuation and refrigerant charging apparatus 12. Refrigerant supply means 84 preferably includes a commercially available refrigerant charging board 124. Refrigerant charging board 124 typically includes a controllable valve for each refrigerant supply connected thereto, such as controllable valves 126 and 128, and refrigerant flow measuring means, such as a flow meter 130. The output of flow meter, for example, may be a train of electrical pulses, with the rate of pulse generation being proportional to the rotation of a rotatable element in flow meter 130. A counter is arranged to count the pulses, with the count indicating the amount of refrigerant which has been metered into refrigeration unit 10.

Controllable valves 126 and 128 connect the first and second refrigerant sources 120 and 122 to different inputs of a refrigerant supply manifold 132, which inputs will be called inputs #1 and #2. Refrigerant supply manifold 132 is connected to the third vacuum hose 100 via a refrigerant conduit 134. Refrigerant conduit 134 is connected to the service valve side of controllable valve 116 via a tee 136. Thus, during the refrigerant charging cycle, all of the controllable valves 108, 112 and 116 associated with vacuum hoses 96, 98 and 100 may be closed.

The length of refrigerant conduit 134, from charging board 124 to tee 136, is made as short as possible, to minimize cross contamination between different types of refrigerant. The parallel refrigerant flow lines connecting controllable valves 126 and 128 to manifold 132 are also as short as possible, such that these parallel refrigerant flow lines, manifold 132 and conduit 134 have very little volume, to minimize such cross contamination.

Display 86 has a LCD read-out portion 138 for displaying alpha-numeric characters, and plurality of visual indicators 140. A keyboard 142 is shown connected to display 86, but keyboard 142 may be connected directly to controller 80, as desired.

According to the teachings of the invention, each refrigeration unit 10 includes a bar code 143 which may be located, for example, on a serial plate affixed to each unit 10. Bar code 143 may be in the standard 3-9 format. Bar code 143 includes information specific to the associated refrigeration unit, such as the production serial number of the unit. A model number of the unit may also be included on the bar code 143. Information which is automatically known once the model number and/or production serial number are known need not be included on the bar code, as apparatus 12 may obtain such associated information from a look-up table stored in ROM 90, with the look-up table being accessed by serial number and/or model number. This type of information includes the type of refrigerant required by the unit, the amount of refrigerant required by the unit, and the values of certain vacuum thresholds to be utilized while evacuating the unit. A bar code reader wand 145 inputs the information stored in bar code 143 into controller 80.

Information stored in the memory means 88 of evacuation and refrigerant charging apparatus 12 may be down loaded to predetermined apparatus, such as by using a personal computer 144 to control the selection and transfer of data to a data base 146 and printer 148.

Figure 5:
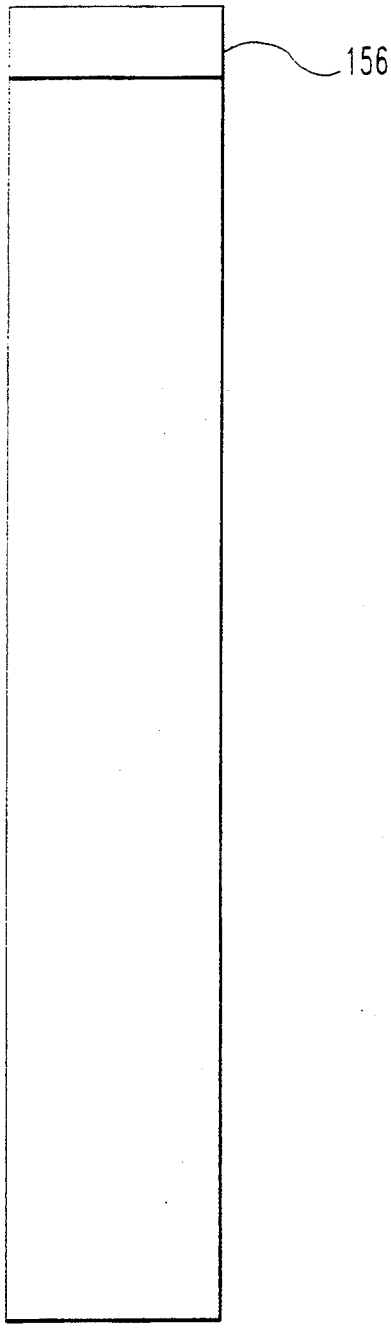
FIG. 5 is a RAM map listing flags, timers, counters, and other program variables, generated and/or used during the operation of the program shown in FIGS. 2A, 2B, 2C and 2D.
Figure 3:
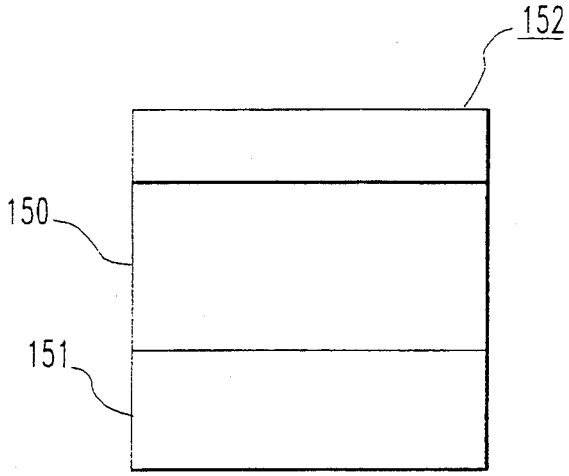
FIG. 3 is a ROM map which lists programs stored in a read-only memory shown in FIG. 1, including the program shown in FIGS. 2A, 2B, 2C and 2D.
Figure 4:
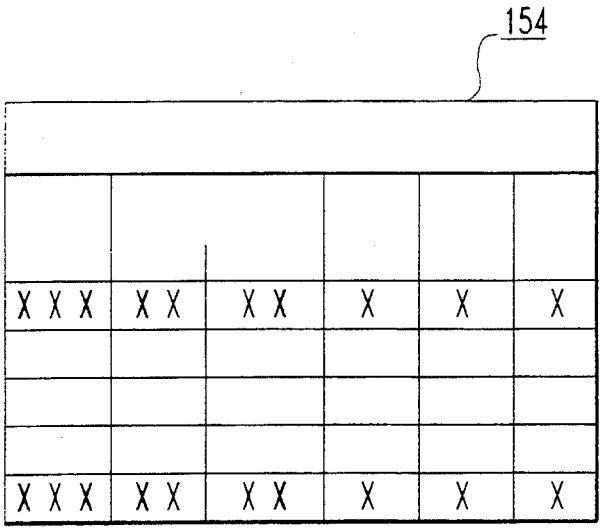
FIG. 4 is a ROM look-up table, stored in a read-only memory shown in FIG. 1, which enables the program shown in FIGS. 2A, 2B, 2C and 2D to determine the type and amount of refrigerant each refrigeration unit requires, as well as certain parameters related to the evacuation of the refrigeration unit.
Figure 6:
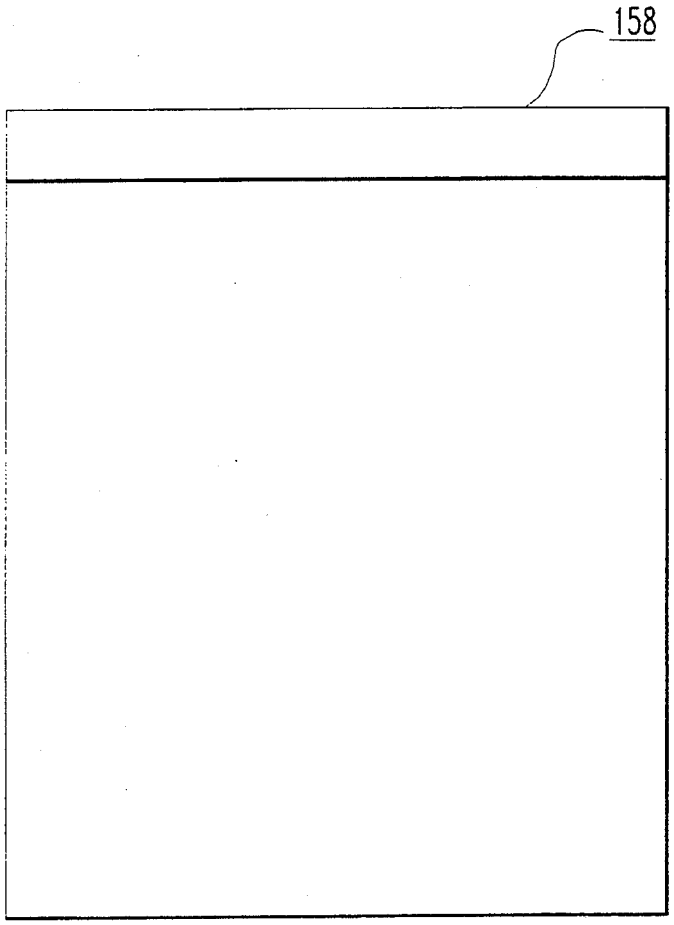
FIG. 6 is a print-out prepared after a refrigeration unit has been evacuated and charged according to the teachings of the invention, with the print-out listing the model and serial numbers of the refrigeration unit, as well as information concerning the evacuation process of the refrigeration unit and the type and amount of refrigerant with which the refrigeration unit was charged.

FIGS. 2A, 2B, 2C and 2D are flow charts which may be combined to provide a program 150 which may be stored in ROM 90 and used to operate apparatus 12 according to the teachings of the invention. During the description of program 150, FIGS. 3, 4, 5 and 6 will also be referred to. FIG. 3 is a ROM map which illustrates application programs which may be stored in ROM 90, including the evacuation and refrigerant charge program 150 shown in FIGS. 2A, 25, 2C and 2D, and a vacuum pump diagnostic program 151. FIG. 4 is ROM map 154 which illustrates the hereinbefore mentioned look-up table which is stored in ROM 90. FIG. 5 is a RAM map 156 of RAM 92 which illustrates flags, counters, timers, constants, variables, and the like, which are used by, or generated by, program 150. FIG. 6 is an exemplary print-out 158 which may be generated by printer 148 after each refrigeration unit 10 has been evacuated and charged with refrigerant.

Figure 2A:
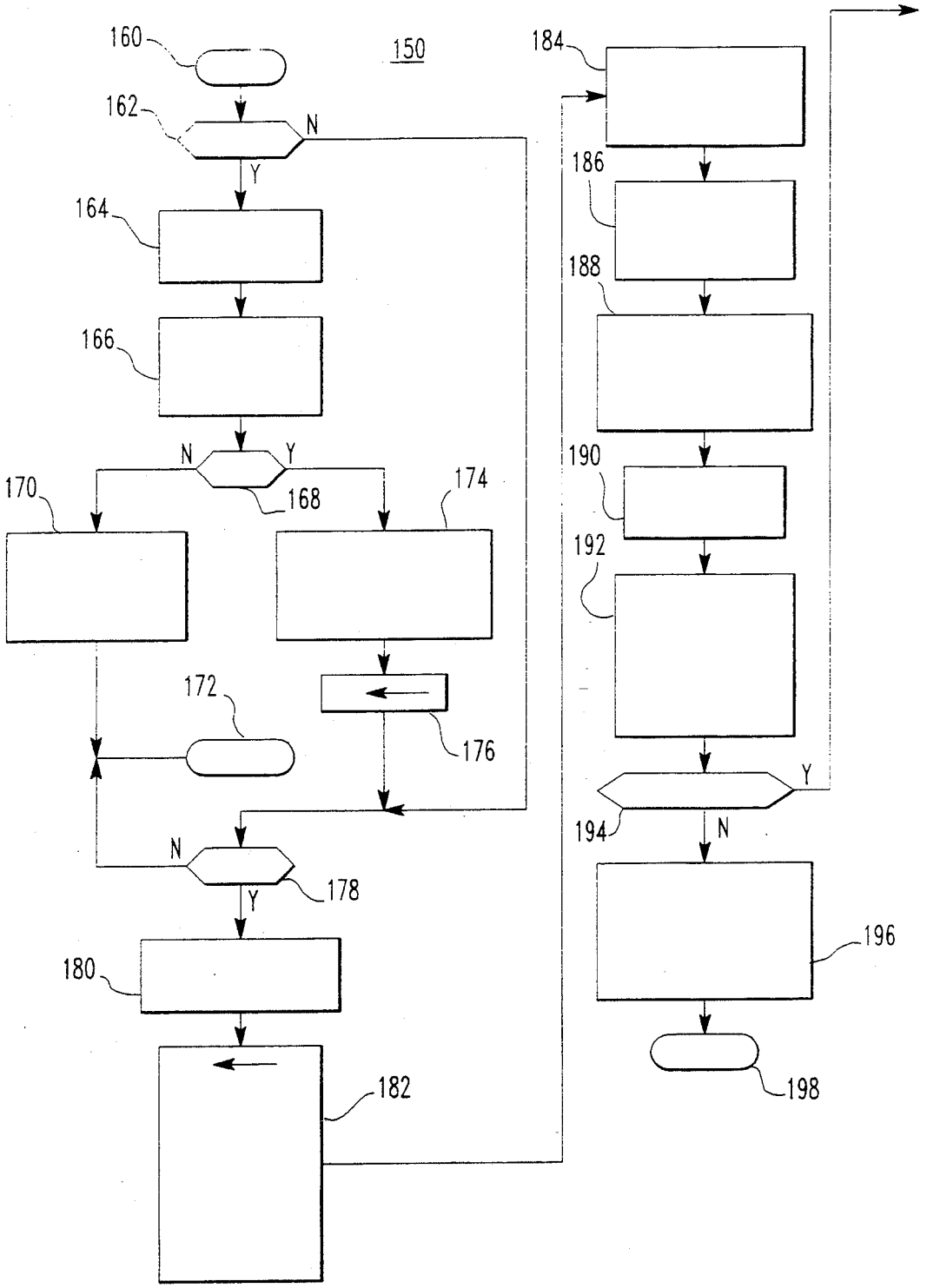
FIGS. 2A, 2B, 2C and 2D may be combined to provide a flow chart of a program for operating the apparatus shown in FIG. 1-according to the teachings of the invention.

Program 150 is entered periodically at 160 in FIG. 2A and step 162 determines if program 150 is being initialized by checking the logic level of a power-up flag PUF stored in RAM 92. Flag PUF will be a logic zero upon initial start up and step 162 advances to step 164 which starts vacuum pump 94. Step 166 fetches and runs the vacuum pump diagnostics program 151 stored in ROM 90. Vacuum pump diagnostics is not a part of the present invention and thus program 151 is not shown in detail. In general, vacuum pump diagnostic program 151 operates vacuum pump 94 to determine whether or not vacuum pump 94 is able to pull a vacuum down to a predetermined value, such as 100 microns, for example. Step 168 determines if vacuum pump 94 has successfully passed the diagnostic tests. When vacuum pump 94 fails to pass, step 170 outputs an alarm message on the alpha-numeric display portion 138 of display 86, which indicates that the vacuum pump should be checked, and program 150 exits at return 172.

When step 168 finds that vacuum pump 94 has passed the diagnostic tests, step 174 outputs a message to an attendant to enter the type or types of refrigerant which are connected in the refrigerant supply means 84. Step 174 directs the attendant by first asking that the refrigerant type connected to refrigerant input #1 be entered, then the refrigerant type connected to refrigerant #2 be entered, etc., until all of the refrigerant inputs have been covered. Step 176 then sets the power up flag PUF to logic one, to indicate to step 162 upon the next running of program 150 that power-up initialization has been completed. Step 176 advances to step 178 which awaits actuation of a start push button located on evacuation and charging apparatus 12, such as on keyboard 142. Program 150 exits at return 172 until step 178 finds that the start push button has been actuated. Each running of program 150 after the power-up flag PUF is set in step 176 results in step 162 branching immediately to step 178, and program 150 cycles through steps 160, 162, 178 and 172 until step 178 finds that the attendant is ready to evacuate and charge a refrigeration unit 10.

When step 178 finds the start button on apparatus 12 has been actuated, step 180 outputs a message to the attendant that the bar code 143 should be scanned, using the bar code reader wand 145. On a production line, bar code reader wand 145 may be located to automatically scan bar code 143 as unit 10 moves into an evacuation and charging location. When the bar code 143 is scanned, step 182 stores all of the information contained in the bar code 143 in RAM 92, including the production serial number of the unit, and the model number of the unit, if provided. Step 182 utilizes the information stored on bar code 143 to obtain from ROM 90 all pertinent information associated with this specific unit. This additional information includes the type RUNIT and amount RAMT of refrigerant required by the unit, and first, second and third vacuum threshold values VT1, VT2 and VT3, respectively. Step 182 also zeros a failure counter FC in RAM 92.

Step 184 then outputs a message to the attendant to connect the evacuation hoses 96, 98 and 100 to unit 10. The attendant may enter a signal via keyboard 142 when this task has been accomplished. Vacuum pump 94 may be checked again, as well as the connections of evacuation hoses 96, 98 and 100 to service valves 22, 38 and 56, via a series of steps which starts with step 186. Step 186 outputs a message to the attendant to back-seat service valves 22, 38 and 56, which closes their service ports, and step 188 outputs logic zero signals to controllable evacuation valves 108, 112 and 116, which closes these valves. Steps 190 and 192 start and run vacuum pump 94 for a predetermined period of time, after which vacuum gauge VG1 is read. Step 194 determines if the reading of VG1 is less than some predetermined acceptable value, such as 100 microns. If the reading of VG1 is not less than the predetermined acceptable value, step 196 outputs a message to check vacuum pump 94 and the controllable evacuation valves 108, 112 and 116, and program 150 exits at return 198.

Figure 2B:
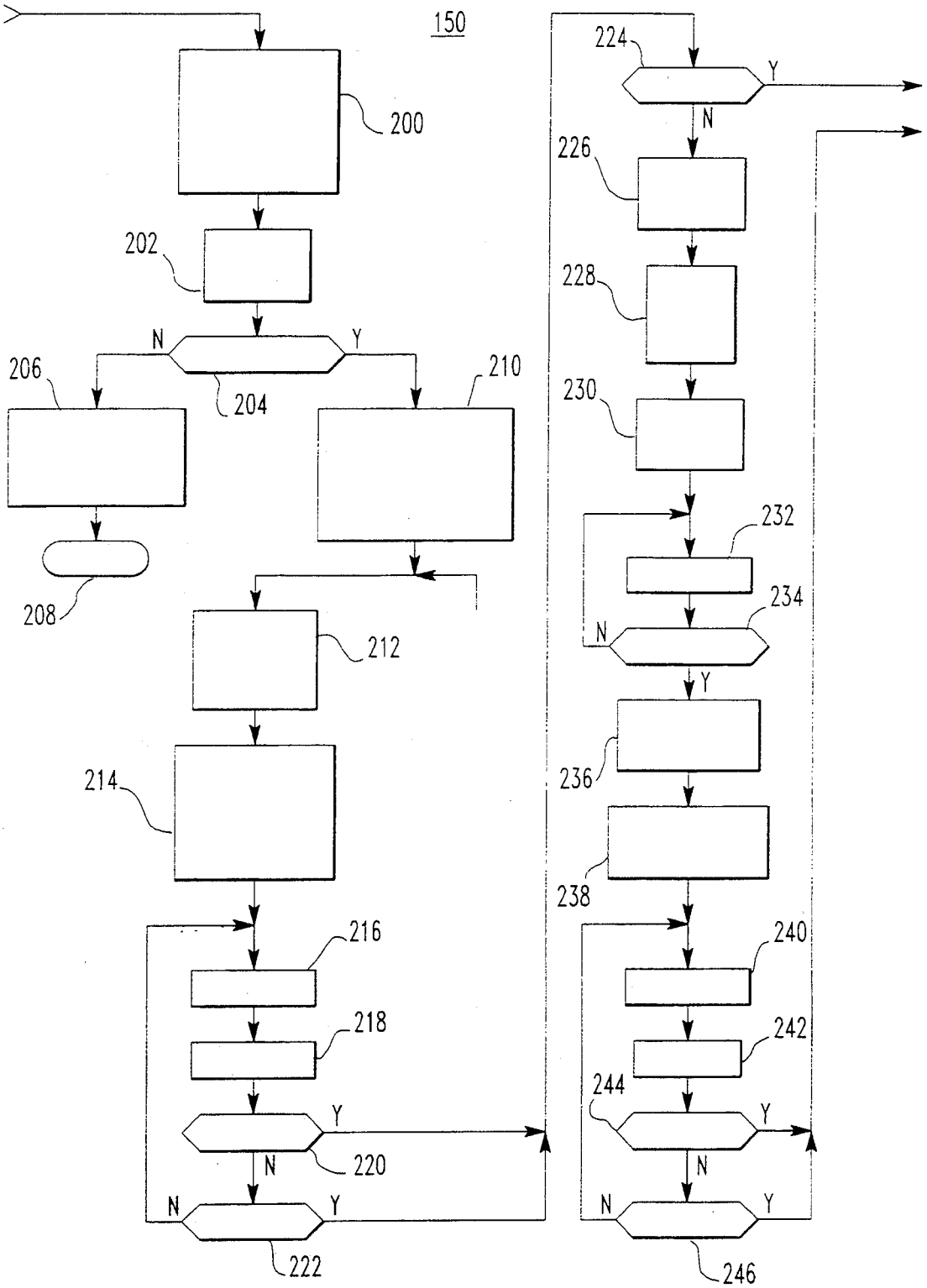

When step 194 finds that vacuum pump 94, vacuum hoses 96, 98 and 100, and controllable valves 108, 112 and 116 are ready to proceed, step 194 branches to step 200 in FIG. 2B. Step 200 opens controllable evacuation valves 108, 112 and 116 and step 202 delays for a predetermined period of time and then reads vacuum gauge VG1 to check the tightness of connectors 106, 110 and 114 to the service ports of service valves 22, 56 and 38. Step 204 compares the reading of VG1 with a predetermined acceptable vacuum value, such as 100 microns, and if VG1 is above this predetermined value, step 206 outputs a message to check the connection of vacuum hoses 96, 98 and 100, and program 150 exits at return 208.

When step 204 finds that the hose connections are tight, step 210 outputs a message to the attendant that the service valves 22, 38 and 56 should be actuated to open their service ports. As hereinbefore stated, the attendant should turn an actuator on each service valve 22, 38 and 56 such that the actuator is half way between back-seated and front-seated positions. Step 212 illuminates a predetermined one of the visual indicator lights 140 on display 86 to indicate that the evacuation process is underway, and step 214 starts the evacuation process.

Step 214 zeros a timer T1 in RAM 92, it fetches the first vacuum threshold value VT1 stored in RAM 92, and it starts evacuation of unit 10. The various time values which will be referred to throughout the following description of the evacuation process will be referred to as being timed by a plurality of different software timers. It is to be understood, however, that a single software timer may used, with controller 80 determining time values from this single timer by noting starting and finishing times on the single timer.

Step 216 updates T1, step 218 reads vacuum gauge VG1, and step 220 determines if VG1 is less than the first threshold value VT1, which, for example, may be 1500 microns. When step 220 finds that VG1 exceeds VT1, step 220 proceeds to step 222 which determines if T1 has exceeded some predetermined maximum time value TMAX. Time value TMAX is selected such that if the vacuum has not been reduced to threshold value VT1 by the end of this time value, there is a leak in unit 10 which makes further evacuation useless. When step 222 finds that T1 has not reached TMAX, step 222 returns to step 216.

The program loop comprising steps 216, 218, 220 and 222 continues until either step 220 finds that the reading of vacuum gauge VG1 has been reduced to the first vacuum threshold value VT1, or time T1 has reached TMAX. Step 224 determines which of these two events broke the program loop, by determining if T1 has reached TMAX. When step 224 finds that T1 has not reached TMAX, it indicates that the evacuation process may proceed, and step 226 stores time value T1 and the reading of vacuum gauge VG1.

Step 228 then initiates a vacuum hold cycle to gas off any moisture trapped in unit 10. Step 228, for example, may output a signal to vacuum pump 94 to close a predetermined valve which initiates vacuum hold. Step 230 zeros a software timer T2, step 232 updates timer T2, and step 234 determines when the value of timer T2 has reached the end of the vacuum hold cycle, which may be 5 minutes, for example. Step 234 returns to step 232 until step 234 finds that the vacuum hold cycle has been completed.

When step 234 finds the vacuum hold cycle has been completed, step 236 opens the vacuum hold valve of vacuum pump 94 to continue evacuation of unit, and step 236 also reads and stores the reading of vacuum gauge VG1, which reading indicates how well unit 10 held the vacuum, compared with the reading of VG1 stored in step 226. Step 238 then zeros a software timer T in RAM 92 and step 238 also fetches the second vacuum threshold value VT2. The second vacuum threshold value may be 800 microns for a truck refrigeration unit, and 1000 microns for a trailer refrigeration unit, for example. Step 238 then proceeds to a software program loop initiated by a step 240, which loop is similar to the program loop which comprised steps 216 through 222. Step 240 updates timer T, step 242 reads vacuum gauge VG1, step 244 determines when VG1 has been reduced to the second vacuum threshold valve VT2, and step 246 determines if the time to reduce the vacuum in unit 10 to the second vacuum threshold value VT2 has reached a predetermined time TMAX. Time TMAX in step 246 may be the same time value used for TMAX in step 222; or, different time values may be used, depending upon the characteristics of unit 10. When the program loop comprising steps 240 through 246 is broken, step 246 proceeds to step 248 in FIG. 2C, to determine which event broke the loop.

Figure 2C:
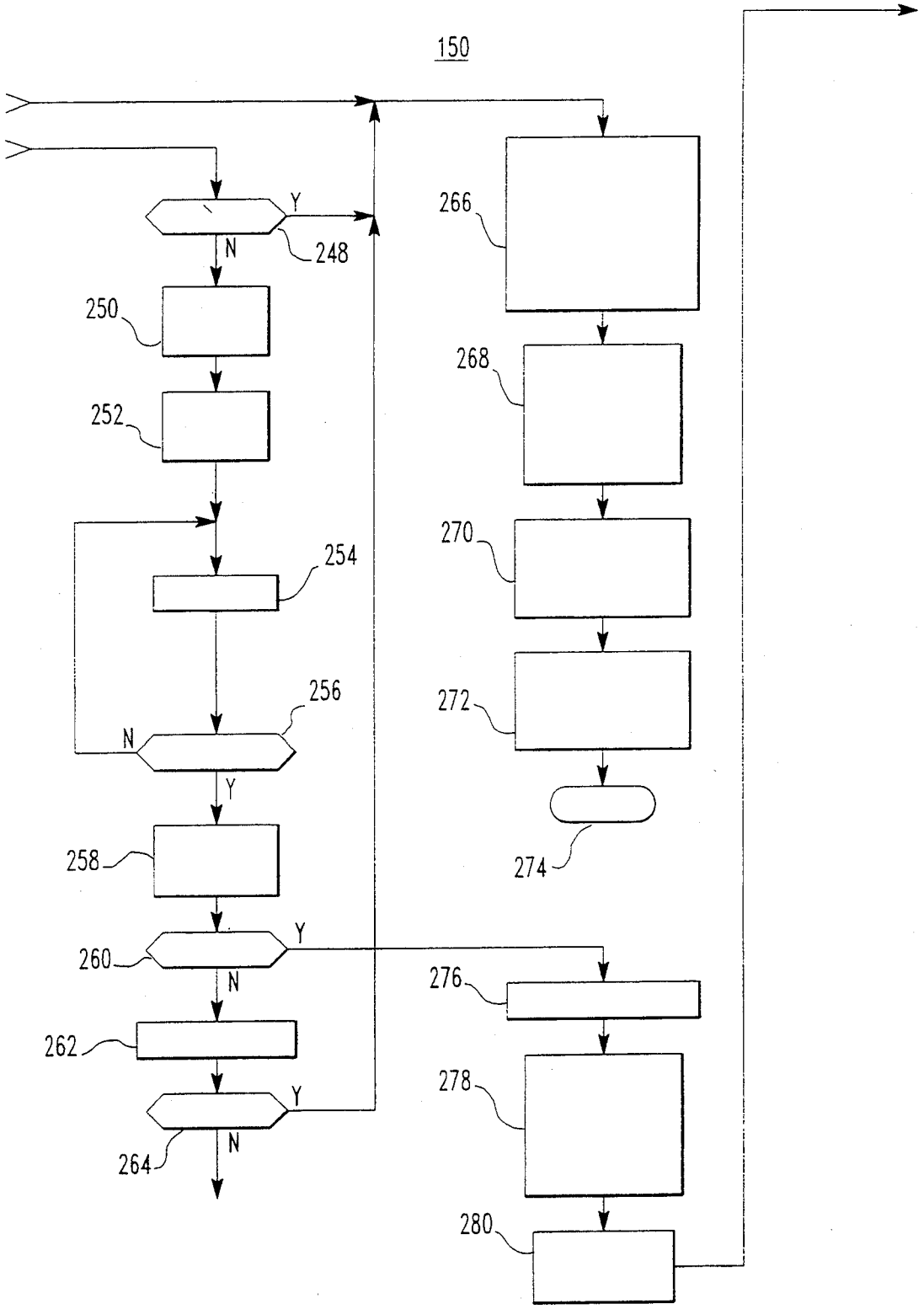
Figure 2D:
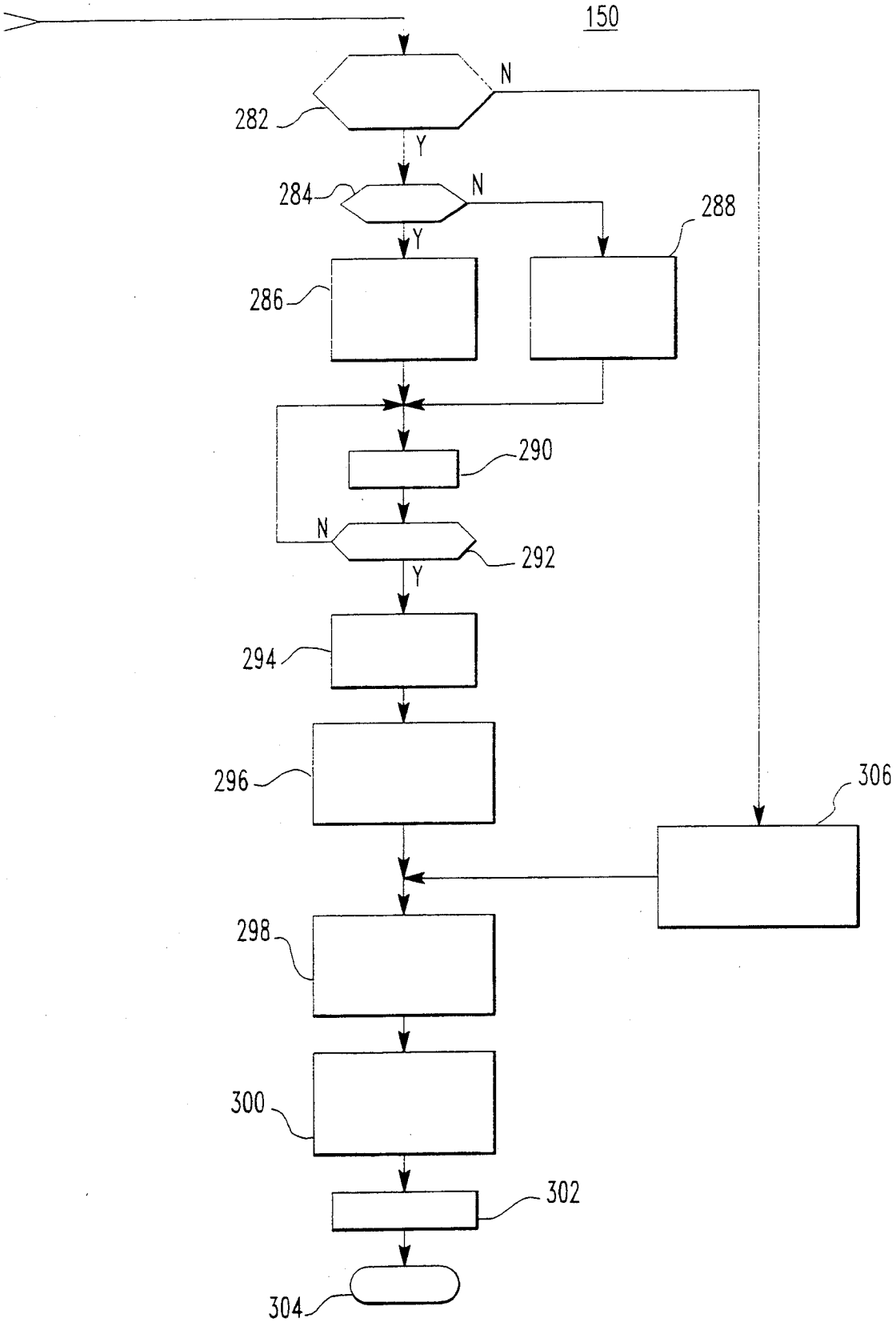

When step 224 finds that the program loop comprising steps 216 through 222 was broken by timer T1 reaching TMAX, step 224 proceeds to step 266 in FIG. 2C, to initiate termination of the evacuation process. Since termination of the evacuation process will also be initiated by step 246 finding that time value T has reached TMAX, description of the termination of the evacuation process will be delayed until after describing the steps which start with step 248 in FIG. 2C.

Step 248 determines which of the two steps 244 or 246 broke the program loop by determining if time value T3 has reached TMAX. If time value T3 has not reached TMAX it indicates that the evacuation process may proceed, and step 248 proceeds to step 250. Step 250 stores time value T3, and the reading of vacuum gauge VG1. A vacuum hold cycle is then initiated by step 250, which is similar to the vacuum hold cycle performed by the hereinbefore described steps 228, 230, 232 and 234. Step 250 actuates a vacuum hold valve on vacuum pump 94, step 252 zeros a software timer T4 in RAM 92, step 254 updates timer T4 and step 256 determines when timer T4 has reached the end of the vacuum hold cycle, such as 5 minutes for example.

When this second vacuum hold cycle has terminated, step 258 fetches the third vacuum threshold value VT3. The third vacuum threshold value is an "upper" vacuum threshold, such as 2000 microns, for example, unlike the first and second vacuum threshold values VT1 and VT2, which are "lower" vacuum threshold values. Step 258 also reads vacuum gauge VG1. Step 260 compares the reading of vacuum gauge VG1 with the third vacuum threshold value VT3 to determine if the vacuum has risen to the third vacuum threshold during the second vacuum hold cycle.

If step 260 finds that reading VG1 has risen to, or above, the third vacuum threshold value VT3, the failure counter FC, which was set to zero in step 182, is incremented. Step 264 determines if the failure counter FC has reached a predetermined value, such as 2. If it has not reached 2, then the entire evacuation process is repeated, with step 264 returning to step 212 in FIG. 2B. Should the program return to step 262 during the second attempt to evacuate unit 10, step 264 will now find that the failure counter has reached 2, and step 264 branches to step 266.

Steps 224 and 248 also branch to step 266 when they respectively find that time values T1 and T3 have reached their respective maximum time values TMAX. Step 266 initiates the termination of the evacuation of the connected unit 10 by turning off the visual evacuation indicator on display 86. Step 266 may also output a message on display 86 that the connected unit 10 has failed the evacuation process, and all pertinent data stored in RAM 92 concerning the evacuation process, including time values and readings of vacuum gauge VG1, may be downloaded to computer 144, which stores the information in data base 146. A report, such as print-out 158 shown in FIG. 6, may also be provided by printer 148, to provide an immediate hard copy of the results of the failed evacuation process which will stay with the associated unit during a subsequent trouble shooting repair process. Step 270 outputs a message to the attendant to back-seat the service valves 22, 38 and 56, to close their service ports. When the attendant indicates on keyboard 142 that the service valves have been back-seated, step 272 outputs a message to the attendant that the vacuum hoses 96, 98 and 100 may now be removed from unit 10, and program 150 exits at return 274.

When step 260 finds that the reading of vacuum gauge VG1 is less than the third vacuum threshold value VT3, the evacuated unit 10 has successfully passed the evacuation portion of program 150 and thus it may now proceed to a refrigerant charging portion of program 150. Step 260 branches to step 276 which flashes the evacuation indicator or light on display 86, to indicate completion of a successful evacuation of unit 10, and step 278 closes evacuation hoses 96, 98 and 100 by outputting logic zeros to controllable evacuation valves 108, 110 and 114. Step 278 advances to step 280 which fetches the type RUNIT, and the amount RAMT, of refrigerant required for the connected unit 10. Step 280 then proceeds to step 282 in FIG. 2D which compares RUNIT with the types of refrigerant which are presently connected to refrigerant supply means 84, which types were input to controller 80 in response to step 174 in FIG. 2A. When step 282 finds that the required type of refrigerant is connected to refrigerant supply means 84, step 282 proceeds to step 284 which determines which of the two inputs the required refrigerant is connected to. If step 284 finds the required refrigerant is connected to input #1, step 286 opens controllable refrigerant flow valve 126. If step 284 finds the required refrigerant is connected to input #2, step 288 opens controllable refrigerant flow valve 128. If there are more than two inputs, then additional steps would be required to determine which of the plurality of inputs has the required refrigerant, and a controllable valve associated with the determined input would be opened.

Steps 286 and 288 both proceed to step 290 which determines how much refrigerant R has been metered into the service port of liquid line service valve 38 of the connected refrigeration unit 10. This is accomplished by counting the output pulses provided by flow meter 130. Step 292 compares the amount of refrigerant R which has been metered into the connected unit 10 with the required amount RAMT. When step 292 finds that the amount of refrigerant R in unit 10 has not reached the required amount RAMT, step 292 returns to step 290, with program 150 looping through steps 290 and 292 until the desired amount RAMT has been reached. When the desired amount RAMT of refrigerant has been reached, step 292 proceeds to step 294 which closes the open controllable refrigerant flow valve. Step 296 then outputs a visual and/or audible signal from display 86 that the evacuation and refrigerant charging of the connected unit 10 has been successfully completed.

Instead of controller 80 counting the output pulses provided by flow meter 130, steps 290 and 292 may be performed by most commercially available refrigerant charging boards 124. In this type of arrangement, controller 80 sets a counter on charging board 124 to the amount of refrigerant required by the unit 10 to be charged, and controller 80 opens the appropriate refrigerant supply valve. When the requisite count is reached, the open refrigerant supply valve is closed by control associated with charging board 124.

Step 296 then proceeds to step 298 which outputs a message to the attendant to back-seat service valves 22, 38 and 56, to close their service ports. After the attendant has signaled via keyboard 142 that the service valves have been back-seated, step 300 outputs a message to the attendant that the vacuum hoses 96, 98 and 100 may be removed from refrigeration unit 10. Step 302 then stores all pertinent information concerning the evacuation of the connected unit 10, the information is downloaded to data base 146 via computer 144, and print out 158 shown in FIG. 6 is printed by printer 148.

When step 282 finds that the required refrigerant is not connected to refrigerant supply means 84, step 282 branches to step 306 which outputs a message to the attendant that the connected unit 10 has been evacuated but not charged, and step 306 advances to the hereinbefore described step 298.

In general, it is better to complete the charging process before the vacuum hoses 96, 98 and 100 are disconnected from unit 10, as the potential exists for air and moisture to enter unit 10 when the evacuation and charging steps are not performed sequentially while the vacuum hoses 96, 98 and 100 are connected to unit 10. The ability to charge unit 10 without disconnecting vacuum hoses 96, 98 and 100 is one of the many advantages of the invention over manual evacuation and refrigerant charging operations which must remove the evacuation hoses before initiating the refrigerant charging of the unit 10. Thus, it is preferred that evacuation and charging apparatus 12 be prepared such that step 282 will always find the proper refrigerant type RUNIT is a component of the refrigerant supply means 84.

I claim:

1. Apparatus for evacuating and charging a refrigeration unit having a compressor; a condenser; a receiver; an evaporator; hot gas, liquid and suction lines; and suction, discharge and liquid line service valves, comprising:

a vacuum pump having first, second and third vacuum hoses with controllable valves, said first, second and third vacuum hoses being adapted for connection to the discharge, suction and liquid line service valves, respectively, controllable refrigerant supply means, means connecting said controllable refrigerant supply means to the third vacuum hose, and control means for controlling the vacuum pump, the controllable valves of the first, second and third vacuum hoses, and the controllable refrigerant supply means, when the first, second and third vacuum hoses are respectively connected to the suction, discharge and liquid line service valves of a refrigeration unit, to automatically evacuate and charge the refrigeration unit with refrigerant, without the necessity of removing vacuum hoses after the refrigeration unit has been evacuated.

2. The apparatus of claim 1 wherein the refrigeration units each include a bar code which enables the amount of refrigerant required for the associated refrigeration unit to be determined, and the control means includes means for reading the bar code, means for determining the amount of refrigerant required for a refrigeration unit to be evacuated and charged, and means for metering the determined amount of refrigerant into a connected refrigeration unit.

3. The apparatus of claim 1 wherein the refrigeration units each include a bar code which enables the type and amount of refrigerant required for the associated refrigeration unit to be determined, the controllable refrigerant supply means includes at least two different types of refrigerant, and the control means includes means for reading the bar code, means for determining the type and amount of refrigerant required for a refrigeration unit to be evacuated and charged, means for selecting the correct refrigerant type from the at least two types of refrigerant, and means for metering the determined amount of the selected type of refrigerant into a connected refrigeration unit.

4. The apparatus of claim 1 wherein the refrigeration units each include a bar code which identifies the unit, and the control means includes means for reading the bar code of a refrigeration unit to be evacuated and charged, means for storing predetermined information during the evacuation and charging of the refrigeration unit, and means for downloading the predetermined information, along with the identification of the unit obtained from the bar code, to predetermined apparatus.

5. The apparatus of claim 1 wherein the control means includes:

means for operating the vacuum pump to pull the vacuum down in a connected refrigeration unit to a first vacuum threshold value, means for recording the time required to reach the first vacuum threshold value, means for initiating a first vacuum hold cycle after reaching the first vacuum threshold value, means for operating the vacuum pump to pull the vacuum down to a second vacuum threshold value after the first vacuum hold cycle, means for recording the time required to reach the second vacuum threshold value, means for initiating a second vacuum hold cycle after reaching the second vacuum threshold value, means for measuring the vacuum at the end of the second vacuum hold cycle, means for comparing the value of the measured vacuum with a third vacuum threshold value, and means for repeating at least once the evacuation of the refrigeration unit when the means for comparing the value of the measured vacuum with the third vacuum threshold value finds the value of the measured vacuum is above the third vacuum threshold value.

6. The apparatus of claim 5 wherein the refrigeration units to be evacuated and charged each include a bar code which identifies the refrigeration unit, and the control means includes means for reading the bar code, means for storing predetermined information during the evacuation and charging of a connected refrigeration unit, including the time values required to reach the first and second vacuum threshold values, and the value of the vacuum measured after the second vacuum hold cycle, and means for downloading the predetermined information, along with the identification of the refrigeration unit obtained from the bar code, to predetermined apparatus.

7. The apparatus of claim 1 wherein the control means includes:

means for operating the vacuum pump to pull the vacuum down to a first vacuum threshold value, means for recording the time required to reach the first vacuum threshold value, means for discontinuing the evacuation procedure when the first vacuum threshold value is not reached within a first predetermined period of time, means for initiating a first vacuum hold cycle when the first vacuum threshold value is reached within the first predetermined period of time, means for operating the vacuum pump to pull the vacuum down to a second vacuum threshold value after the first vacuum hold cycle, means for recording the time required to reach the second vacuum threshold value, means for discontinuing the evacuation procedure when the second vacuum threshold value is not reached within a second predetermined period of time, means for initiating a second vacuum hold cycle when the second vacuum threshold value is reached within the second predetermined period of time, means for measuring the vacuum at the end of the second vacuum hold cycle, means for comparing the value of the measured vacuum with a third vacuum threshold value, and means for repeating at least once the evacuation of a connected refrigeration unit when the means for comparing the value of the measured vacuum with the third vacuum threshold value finds the value of the measured vacuum is above the third vacuum threshold value.

8. The apparatus of claim 7 wherein the refrigeration units to be evacuated and charged each include a bar code which identifies the associated refrigeration unit, and the control means includes means for reading the bar code of a unit to be evacuated and charged, means for storing predetermined information during the evacuation and charging of a refrigeration unit, including time values required to reach the first and second vacuum threshold values, and the value of the vacuum measured after the second vacuum hold cycle, and means for downloading the predetermined information, along with the identification of the unit obtained from the bar code, to predetermined apparatus.

* * * * *